US006322760B1

(12) United States Patent
Busson et al.

(10) Patent No.: US 6,322,760 B1
(45) Date of Patent: Nov. 27, 2001

(54) PROCESS AND APPARATUS FOR THERMAL CONVERSION OF HYDROCARBONS TO ALIPHATIC HYDROCARBONS WHICH ARE MORE UNSATURATED THAN THE STARTING PRODUCTS, COMBINING A STEAM CRACKING STEP AND A PYROLYSIS STEP

(75) Inventors: Christian Busson, Charbonniere; Jean-Pierre Burzynski, Sainte-Foy-les-Lyon; Pierrr Marache, Malmaison; Christian Dubois, Argenteuil, all of (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 0 days.

(21) Appl. No.: 09/389,224

(22) Filed: Sep. 3, 1999

Related U.S. Application Data

(62) Division of application No. 08/851,998, filed on May 6, 1997, now Pat. No. 5,976,352.

(30) Foreign Application Priority Data

May 6, 1996 (FR) ..... 96/05760

(51) Int. Cl.[7] ..... F28D 7/00; B01J 8/08

(52) U.S. Cl. ..... 422/198; 422/200; 422/214; 202/114; 208/132

(58) Field of Search ..... 422/198, 199, 422/200, 214; 585/648, 503, 636, 920, 921, 924, 925, 926; 208/48 R, 132; 201/18; 202/114

(56) References Cited

U.S. PATENT DOCUMENTS

| | | | | |
|---|---|---|---|---|
| 1,470,359 | | 10/1923 | Greenstreet . | |
| 3,641,190 | | 2/1972 | Kivlen et al. . | |
| 4,329,150 | * | 5/1982 | Drinkard et al. | 23/230 A |
| 4,376,694 | | 3/1983 | Lohr et al. . | |
| 4,426,278 | * | 1/1984 | Kosters | 208/130 |
| 4,492,624 | | 1/1985 | Johnson et al. . | |
| 4,552,644 | | 11/1985 | Johnson et al. . | |
| 5,186,815 | | 2/1993 | Lenglet . | |
| 5,242,574 | * | 9/1993 | Broutin et al. | 208/48 R |
| 5,829,747 | | 10/1998 | Lenglet et al. . | |
| 6,027,635 | * | 2/2000 | Busson et al. | 208/48 R |

FOREIGN PATENT DOCUMENTS

| | | |
|---|---|---|
| 0 542 597 | 5/1993 | (EP) . |
| 0 666 104 | 8/1995 | (EP) . |
| 0 733 609 | 9/1996 | (EP) . |
| 1 501 836 | 10/1967 | (FR) . |

* cited by examiner

*Primary Examiner*—Bekir L. Yildirim
(74) *Attorney, Agent, or Firm*—Millen, White, Zelano & Branigan, P.C.

(57) ABSTRACT

A continuous pyrolysis and decoking process and apparatus is described for the production of acetylenic compounds, in which hydrocarbons and steam are circulated in at least one tube (31) of a steam cracking reactor (30) and steam is circulated in at least one tube (32) of that reactor. The hydrocarbon effluent and steam then circulate in at least one row (1) of a pyrolysis reactor (40) and the decoking effluent comprising steam circulate in at least one other row (2) of that reactor (4) to effect decoking. A set of valves V1, V2, V11, V12 is used to alternate the pyrolysis step path and the decoking step path. The temperature in the steam cracking furnaces is lower than that in the pyrolysis reactor.

7 Claims, 1 Drawing Sheet

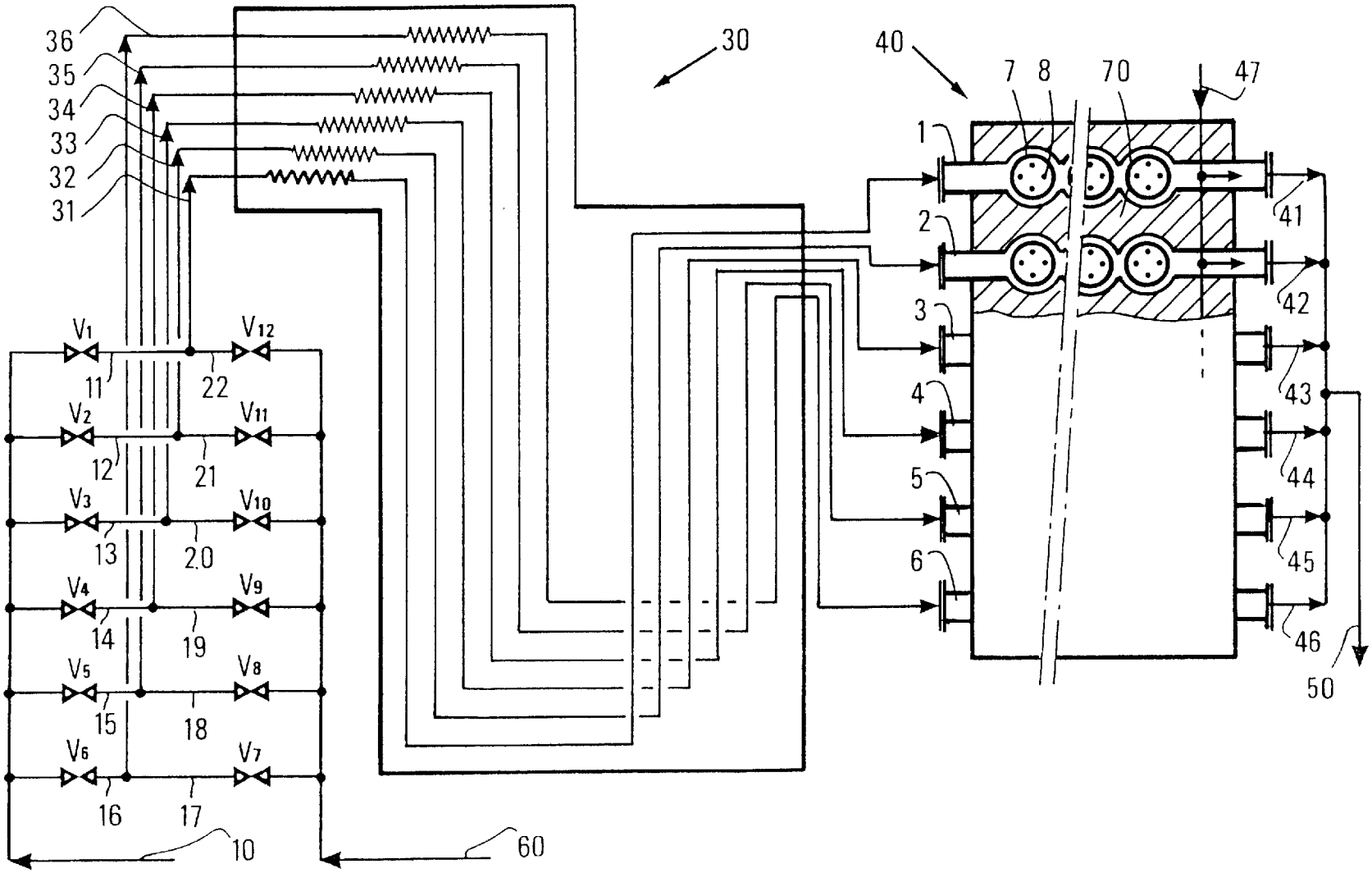
40
30
47
70
7 8
1
2
3
4
5
6
41
42
43
44
45
46
50
60
10
36
35
34
33
32
31
V1
V2
V3
V4
V5
V6
V7
V8
V9
V10
V11
V12
11
12
13
14
15
16
17
18
19
20
21
22

PROCESS AND APPARATUS FOR THERMAL CONVERSION OF HYDROCARBONS TO ALIPHATIC HYDROCARBONS WHICH ARE MORE UNSATURATED THAN THE STARTING PRODUCTS, COMBINING A STEAM CRACKING STEP AND A PYROLYSIS STEP

CROSS-REFERENCE TO RELATED APPLICATIONS

This application is a divisional of patent application Ser. No. 08/851,998, filed May 6, 1997 now U.S. Pat. No. 5,976,352. The priority filing date of the 08/851,998 application is hereby claimed.

BACKGROUND OF THE INVENTION

The invention concerns a process for the pyrolysis of a hydrocarbon feed containing at least two carbon atoms which is carried out simultaneously with decoking of the coke deposited on the reactor walls.

It is of particular application to the continuous production of acetylene or acetylenic compounds such as methyl acetylene.

In processes for the high temperature thermal transformation of hydrocarbons containing at least one carbon atom, for example pyrolysis between 900° C. and 1500° C. or steam cracking at about 850° C. near the end of the heating zone, coke forms and deposits on the surface of the reactor walls. The reactor is then decoked, normally using an air/steam mixture at temperatures which are usually below 900° C., attempting in the case of metal furnaces to avoid any overheating or hot spots which could damage the metal tubes of the furnace. Exothermic decoking thus requires the whole unit to be shut down and in particular, it requires the furnace to be disconnected from the downstream heat exchangers, reducing the total productivity of the unit. Further, safety regulations require the hydrocarbon introduction lines to be disconnected and replaced by air introduction lines, thus requiring a very long downtime for the unit.

The same disadvantages are there when rebuilding the unit for the pyrolysis phase, with the additional necessity of purging the reaction zone and lines with an inert gas.

Pyrolysis of hydrocarbons containing at least two carbon atoms to produce olefinic or acetylenic hydrocarbons has been described, in particular in our French patent application FR-A-2,715,583 (U.S. Pat. No. 5,554,347), European patent EP-A-0 733 609 and FR 95/15527, which are hereby incorporated by reference.

The prior art is illustrated by patents EP-A-0,542,597 and FR-A-1,501,836.

Pyrolysis reactors of ceramic material have been used in which non impermeable walls which are advantageously of ceramic material determine channels in which the feed and the reaction effluents circulate. These walls advantageously have a shape which is adapted to create turbulence and which, for example, comprise cells or cavities about the heating means. These latter are generally sleeves containing an electric heating element or a gas burner.

These high technology reactors, however, require high investment costs and their energy requirement, in particular of electrical energy, results in high operating costs. European patent application EP-A-0 733 609 describes the possibility of using a steam cracking effluent, as a feed for the pyrolysis reactor as it already contains unsaturated hydrocarbons. The energy required to convert the feed to acetylenic would then be greatly reduced.

However, industrial steam cracking must be stopped every two to three months for decoking. A pyrolysis furnace operating at a higher temperature must be decoked more frequently, for example every four to five days. During the decoking step, the furnace must be isolated. Unfortunately, sealing valves which operate between 800° C. and 900° C. do not exist. An alternative thus consists of sending the effluent from the steam cracker to the pyrolysis furnace, following cooling by passage through a transfer line exchanger, but the benefit of using hot gas is lost and the gain is thus small. Further, the dead volume of the transfer line exchanger encourages secondary reactions to the detriment of the yield of ethylene.

A further disadvantage is linked to the frequency of tube decoking, every two to three months. At the end of a cycle, the inside of the tubes is covered with a thick layer of coke. Coke tends to detach itself at times and is entrained by the gas, stream at speeds which are of the order of 200 m/s, risking damage to the ceramic material sleeves in the pyrolysis furnace downstream of the steam cracking furnace.

SUMMARY OF THE INVENTION

One aim of the invention is to provide a process which can pyrolyse a hydrocarbon feed without stopping the unit, but which can decoke the unit.

A further aim is to reduce the investment and operating costs of the unit.

A still further aim of the invention is to maintain the temperature of the facility substantially constant during operation to avoid thermal stresses which would otherwise occur, in particular during use of a gas containing oxygen for the decoking step, which is an exothermic reaction, while the pyrolysis step uses an endothermic reaction.

Because of the presence of non impermeable (and therefore cheap) walls in the pyrolysis zone, it has been observed that it is possible to carry out a continuous pyrolysis process for a hydrocarbon feed and a reaction zone decoking process with no deleterious effects.

It has been observed that by combining a steam cracking furnace operating with a high degree of dilution of the feed with steam and at least one very high temperature pyrolysis furnace, with no transfer line exchanger between the steam cracking furnace and the pyrolysis furnace, excellent selectivity towards the desired products is obtained for a reduced overall enthalpy requirement.

More precisely, the invention concerns a continuous pyrolysis and decoking process carried out in a reaction zone comprising a pyrolysis zone (40) which is of refractory material, which zone is elongate in one direction (one axis), and which comprises a heating zone and a cooling zone following the heating zone, the heating zone comprising at least two rows (1, 2) which are substantially parallel to the axis separated by a wall (70), which is advantageously non impermeable, of refractory material and located between two successive rows, at least one of said rows (1) receiving hydrocarbons and steam, at least one other (2) of said rows receiving essentially steam, said rows comprising heating means (8) surrounded by sleeves (7) which are substantially parallel to each other and substantially perpendicular to the reactor axis, wherein coke is deposited in the reaction zone, the process being characterized in that a hydrocarbon feed comprising at least one hydrocarbon containing at least two carbon atoms is circulated at a temperature which is sufficient for steam cracking in a steam cracking zone containing at least two steam cracking tubes, at least one of said tubes communicating with a supply for feed and steam and being heated so as to crack the feed, at least one other of said tubes communicating with a supply for a fluid consisting essentially of steam and being heated so as to decoke said tube on which coke has been deposited, the flow rate of steam in the steam cracking tube being such that the steam/feed weight ratio is in the range 0.5 to 20, a steam cracking gas stream comprising hydrocarbons and steam and a decoking gas stream comprising essentially steam are obtained and the steam cracking stream is circulated in at least one row of the heating zone in the pyrolysis zone (40) which is adjacent the steam cracking zone so as to pyrolyse the steam cracking stream and to produce a temperature of at least 850° C. at the outlet from said heating zone, and the decoking stream is circulated in at least the other row of the heating zone so as to decoke said row at least in part, and to produce a temperature of at least 850° C. at the outlet from said heating zone, and in which hydrocarbons comprising at least one acetylenic compound, for example acetylene, are recovered, along with a decoking effluent.

In one feature of the invention, the temperature at the outlet from the steam cracking zone is generally lower than the temperature at the outlet from the heating zone of the pyrolysis zone.

The temperature in the steam cracking tube or tubes in which steam cracking of the feed is carried out is advantageously kept substantially equal to the temperature in the tubes in which decoking is carried out. Similarly, the temperature in the row or rows in which pyrolysis of the gas stream leaving the steam cracking zone is carried out is advantageously kept substantially equal to the temperature in the row or rows in which decoking is carried out.

According to another particularly advantageous feature, the outlet temperature from the heating zone for the hydrocarbons and the outlet temperature from the heating zone for the decoking effluent are about 1000° C. to 1400° C.

In a further feature, the quantity of steam introduced into the steam cracking zone, with respect to that of the feed, in other words with respect to the steam-to-feed weight ratio, is higher for a given feed than that corresponding to conventional steam cracking of the same feed. In general, the ratio adopted is that which is the most appropriate to the pyrolysis reaction following the steam cracking reaction.

Thus for a feed consisting essentially of ethane, this ratio is more than 0.5, while it is normally about 0.2. For a naphtha feed, the ratio is more than 0.7 when it is normally about 0.5. As an example, for a gas oil, the ratio is more than 1, for example 2, while it is normally more than 1.

Excellent selectivity results have been obtained with a steam-to-feed ratio which is in the range 1.5 to 6, the highest value preferably being adapted for the heaviest feeds.

The choice of these ratios combined with a high reaction temperature, both for the steam cracking zone and for the heating zone in the pyrolysis zone, facilitates decoking of the tubes and rows since these constitute sufficiently oxidising conditions at these temperatures to transform the coke and produce carbon monoxide and hydrogen.

This is particularly advantageous with a ceramic reactor with non impermeable walls. Steam and hydrogen can then transfer through the wall of the row where decoking is occurring to the row in which pyrolysis takes place.

It has been observed that a transfer of hydrogen towards the pyrolysis row slows down deposition of coke thereon.

Further, a transfer of steam from the row in which decoking is taking place to the row in which pyrolysis takes place is not a problem since the pyrolysis reaction is carried out in the presence of steam. In the other direction, if hydrocarbons pass from the pyrolysis row to the row in which decoking is taking place, they find themselves in the presence of a great deal of water and are pyrolysed to the desired products without making additional coke.

Finally, the choice of a high steam-to-feed ratio has the advantage of reducing coke deposition. This latter cannot increase to a great extent since it is intended that decoking is carried out every four or five days, i.e., at a frequency which corresponds to that of decoking the pyrolysis reactor, instead of decoking every two to three months in the case of industrial steam crackers.

This reduction in coke deposition due to the high steam content and frequency of decoking encourages heat transfer through the tubes (coke deposits form a heat barrier), and thus the skin temperatures of the tubes are lower than those of industrial steam crackers, resulting in an improvement in the selectivity towards ethylene with over the latter.

Since the steam cracker is connected to the pyrolysis furnace by a very short conduit there is practically no dead volume while when the effluent from an industrial steam cracker is used as a feed for the pyrolysis reactor, having to cool the gas in a heat exchanger creates a large dead volume in which undesirable secondary products form, by high temperature degradation of ethylene and acetylene.

It has been shown that by using a steam flow rate in the tube in which decoking takes place which is 1.1 to 4 times greater than the flow rate of the steam introduced into the tube in which steam cracking occurs, very good decoking results are obtained for these tubes. Of course, the rate of decoking of the heating rows adjacent the decoked tubes is also improved since this excess steam also circulates in the rows in which decoking occurs.

In order to carry out this decoking step, the hydrocarbon supply to the tube which is to be decoked is cut and the water flow rate which is introduced is increased so as not to cause too great a thermal shock in the gas preheating furnace upstream of the steam cracking zone.

The steam cracking furnace is normally heated using conventional radiant type gas burners. The feed is generally preheated to between 300° C. and 400° C. The temperature in the steam cracking zone is normally at most 900° C.

The heating means in the pyrolysis reactor can be electrical resistors contained in sleeves such as those described in the above patents or they may be constituted by sleeves containing a gas burner such as that described in our French patent application (FR-A-2 715 583).

Each row can comprise at least one layer of heating means, which layer is substantially parallel to the axis of the reaction zone, surrounded by sleeves which are substantially perpendicular to the axis.

The characteristics of the heating elements, whether electric or comprising gas burners, their number, distance apart and configuration are described in the patents cited above.

The same is true for the sleeves protecting them and isolating them from the fluids circulating in the reactor.

These same heating elements and sleeves with the same characteristics and configurations can occur both in the pyrolysis zone and in the zone (or row) in which steam decoking is carried out.

It has been observed that in the presence of electrical heating elements contained in relatively porous and cheap ceramic sleeves in which the impermeability is not perfect, a sleeve gas containing hydrogen and/or steam and/or carbon monoxide and/or an inert gas can be used and further, could diffuse from the inside to the outside of the sleeves without perturbing the pyrolysis reaction and without perturbing the decoking reaction.

In a first variation, the recovered hydrocarbons and the decoking effluent are mixed before being introduced into the cooling zone.

In a second variation, the recovered hydrocarbons and the decoking effluent are separately cooled in their respective rows, located in the cooling zone, then they may be mixed.

The cooling zone is usually a direct chilling zone which uses a cooling fluid, and is known to the skilled person, advantageously followed by a transfer line exchanger (TLE) which generates steam.

The unit has the advantage of being safe, reliable and easy to operate. In the pyrolysis zone, refractory materials, and more particularly ceramic materials known to the skilled person such as cordierite, mullite, silicon nitride or silicon carbide, are used.

Non limiting examples of suitable hydrocarbon feeds are:

saturated aliphatic hydrocarbons such as ethane, alkane mixtures (LPG), petroleum cuts such as naphthas, atmospheric gas oils and vacuum gas oils, the latter having an end boiling point of the order of 570° C.;

unsaturated hydrocarbons such as ethylene, propylene, and butadiene, mixtures of alkanes and alkenes such as ethane+ethylene, and $C_3$, $C_4$ and $C_5$ steam cracking and catalytic cracking cuts.

The invention also concerns a continuous pyrolysis and decoking unit particularly for carrying out the process of the invention, comprising a pyrolysis reactor (40) which is elongate in one direction (one axis) comprising at least two rows (1, 2) which are substantially parallel to the axis separated by a wall (70), which is preferably not impermeable, of refractory material located between two successive rows, each row comprising a plurality of heating means (8) disposed in at least one layer of heating elements surrounded by sleeves (7) of ceramic material which are substantially parallel to each other and substantially perpendicular to the reactor axis, at least one of the rows (1) being adapted to receive hydrocarbons and steam, at least one other (2) of said rows being adapted to receive steam, said pyrolysis reactor comprising means for heat control and modulation connected to the heating means, the pyrolysis reactor further comprising cooling means (47) for the effluents produced in each row, said unit being characterized in that it comprises a steam cracking reactor (30) comprising at least two steam cracking tubes (31, 32), each of said tubes (31, 32) being connected to an extremity of a supply line for a feed (11, 12) comprising a regulating valve (V1, V2) and a supply line (22, 21) for steam comprising a regulating valve (V12, V11), the other extremity of tube (31) being connected to the row (1) receiving hydrocarbons and steam and the other extremity of tube (32) being connected to the row (2) receiving steam, the steam cracking reactor further comprising means for alternately activating said valves such that one tube (31) is in the steam cracking phase and the other tube (32) is in the decoking phase, and heat regulation means such that the temperature of the steam cracking reactor is lower than that of the pyrolysis reactor.

The invention will be better understood from the description of an embodiment, which is given purely by way of illustration and is in no way limiting, and which is given with reference to the accompanying Figure which shows a transverse cross section of a steam cracker followed by a longitudinal cross section of a pyrolysis reactor on a plane which is parallel to the axis of the reactor (top view).

Hydrocarbon supply lines 11, 12, 13, 14, 15 and 16 controlled by valves V1, V2, V3, V4, V5 and V6 introduce the hydrocarbons, for example ethane, into a steam cracker 30 then into a hydrocarbon pyrolysis and decoking reactor 40 via a line 10 mixed with water which is generally in the form of steam supplied via line 60. This line distributes the steam to lines 17, 18, 19, 20, 21 and 22 which are controlled by valves V7, V8, V9, V10, V11 and V12 respectively.

Valves V1 to V12 are adapted to allow circulation of a mixture of hydrocarbons and steam in a certain number of steam cracking tubes 30 and pyrolysis rows adjacent reactor 40 and only steam into other tubes of steam cracker 30 and other rows adjacent decoking reactor 40 to remove coke which is deposited during the respective steam cracking and pyrolysis reactions.

Steam cracking tubes 31, 32, 33, 34, 35 and 36 transport the mixture of hydrocarbons and water or transport water alone, and are respectively connected to lines 11 and 22, 12 and 21, 13 and 20, 14 and 19, 15 and 18 and finally, 16 and 17. These tubes are heated in steam cracker 30 to a temperature of 850° C. to 900° C. to crack a portion of the hydrocarbon feed and are respectively connected to rows 1, 2, 3, 4, 5 and 6 of pyrolysis reactor 40.

As an example, since valve V1 closes line 11, tube 31 receives only steam supplied via line 22 controlled by valve V12. In contrast, tubes 32, 33, 34, 35 and 36 receive the mixture of hydrocarbons and water, all the other valves mentioned being open.

The tube assembly is preheated to about 400° C., essentially by convection heating in the first portion of the heating furnace, then to about 900° C. in the second portion of the furnace, essentially by radiation heating, using a plurality of burners.

The steam cracking effluent is introduced into pyrolysis reactor 40 via very short connecting lines which do not have any chilling function.

Pyrolysis reactor 40 adjacent to steam cracking reactor 30 is divided into longitudinal rows (1, 2, 3, 4, 5 and 6) which are substantially parallel to its axis. These rows are separated from each other by non impermeable walls 70 which are of ceramic material, the shape of which includes cells adapted to encourage turbulence inside the row and thus to encourage the reaction. These rows contain sleeves of ceramic material 7 forming a layer which is substantially parallel to the reactor axis. These sleeves are substantially parallel to each other and substantially perpendicular to the reactor axis. They contain, for example, a plurality of electrical resistors 8 bathed in a sleeve gas which is selected from the group formed by steam, hydrogen, carbon monoxide, an inert gas and a mixture of two or more of these gases.

Tube 31 containing steam is connected to row 1 of reactor 40 by a heated line which is as short as possible. Generally, the flow rate of the steam introduced into the tube and row in which decoking is carried out is increased, for example to 2 to 3 times that used in the other tubes 32, 33, 34 and 35 and rows 2, 3, 4, 5 and 6 where pyrolysis takes place. The temperature of the outlet from pyrolysis reactor 40 is heated to about 1200° C.

The terminal portion of the various rows of reactor 40, intended for pyrolysis or decoking, receives pyrolysis or decoking effluents and each row is connected to a direct chilling line 47, comprising a controlled rate injector, for example for ethane if the feed is ethane, to cool the effluents. Once cooled to 800° C., for example, lines 41, 42, 43, 44, 45 and 46 which are connected to rows 1, 2, 3, 4, 5 and 6 respectively mix the various effluents which are evacuated via a line 50.

In a further embodiment, which is not illustrated, the effluents can be cooled by circulation through sealed conduits located in the terminal portion of the rows by indirect chilling then mixing as described above.

In a further embodiment which is not illustrated, the pyrolysis effluents and the decoking effluents from rows 1, 2, 3, 4, 5 and 6 are collected by lines 41, 42, 43, 44, 45 and 46 then mixed and sent to a direct or indirect quenching zone and, once cooled, evacuated via line 50.

Heating elements 8 in the pyrolysis reactor are independently supplied with electrical energy by means of a pair of electrodes which are not shown in the figure, pyrometric sensor thermocouples which are not illustrated are located in spaces in which the feed circulates and the temperature of each heating section can be automatically regulated using a conventional regulation and modulation device which is not shown in the figure, depending on the temperature profile selected. This applies both to the pyrolysis reaction and to that of decoking the sleeve walls.

A temperature regulating means, which can be the same, can control the temperature of the burners in the steam cracker such that this temperature is lower than the outlet temperature of the recovered hydrocarbons and the final decoking effluent from the pyrolysis reactor.

BRIEF DESCRIPTION OF THE DRAWINGS

FIG. 1 is a schematic diagram of a continuous pyrolysis and decoking process and apparatus for the production of acetylenic compounds. Hydrocarbons and steam are circulated in at least one tube (31) of a steam cracking reactor (30) and steam is circulated in at least one tube (32) of that reactor. The hydrocarbon effluent and steam then circulate in at least one row (1) of a pyrolysis reactor (40) and the decoking effluent comprising steam circulate in at least one other row (2) of that reactor to effect decoking. A set of valves V1, V2, V11, and V12 is used to alternate the pyrolysis step path (V1 and V2) and the decoking step path (V11 and V12).

EXAMPLE

A steam cracker- pyrolysis reactor assembly as described in FIG. 1 was used to crack a mixture of ethane and steam to produce a mixture of ethylene and acetylene. The steam to ethane ratio was 1.8 by weight.

The mixture (ethane-water) and decoking steam were heated to 900° C. in steam cracking reactor 30 and heated substantially linearly to 1200° C. in the pyrolysis reactor at an absolute pressure of 1.3 bar.

The steam cracker comprised six heated tubes.

The reactor had six heating rows which were substantially parallel to its axis and separated by walls with cell-like walls of a ceramic material such as silicon carbide. Each row comprised a layer of electrical heating elements parallel to the axis. The sleeves, which were perpendicular to the reactor axis, surrounded the electrical resistors, were of silicon carbide and contained a sleeve gas, nitrogen.

Five steam cracker heating tubes (nos. 31, 33, 34, 35 and 36) and five rows of the pyrolysis reactor (nos. 1, 3, 4, 5 and 6) operated in pyrolysis mode while a single heating tube (no. 32) and a single row (no. 2) operated in decoking mode.

258 kg/h of ethane and 464 kg/h of steam were introduced into each steam cracking tube. 979 kg/h of steam was introduced into the tube which was operating in decoking mode, via valve V11. Hydrocarbon valve V2 was closed.

The steam cracking effluent containing hydrocarbons, hydrogen and steam was directly introduced into the appropriate rows of the pyrolysis reactor. The decoking effluent from the tube was directly introduced into the row in the pyrolysis reactor which was in decoking mode. At the pyrolysis reactor outlet, the pyrolysis effluent was cooled to 800° C. by direct contact with 91 kg/h of ethane at 16° C. while the decoking effluent was cooled to 800° C. by direct contact with 85 kg/h of ethane at 16° C.

After 72 hours of pyrolysis in row no. 1, decoking thereof was commenced. The ethane flow was cut off by valve V1 and to avoid disturbing the thermal conditions in the steam cracker and the pyrolysis furnace, the steam flow rate (valve V12) was increased to 979 kg/h. Simultaneously, tube 32 and row no. 2 were supplied with 258 kg/h of ethane and 464 kg/h of water vapour by opening valve V2 and valve V11.

Decoking completion was indicated by the disappearance of carbon monoxide, which was analysed on-line by infrared, for example, at the pyrolysis furnace outlet.

Decoking was seen to be almost complete after 14 hours in each tube and row where it was carried out, after which the steam cracking reaction was immediately recommenced in the tube which had been decoked and pyrolysis was immediately recommenced for the decoked row.

Thus five tubes were in steam cracking mode connected to five rows which were in pyrolysis mode and one tube in the steam cracking reactor connected to one row in the pyrolysis reactor were in decoking mode. 536 kg/h of ethylene and 450 kg/h of acetylene were produced continuously and with no prolonged stoppages. The effluents from the six rows in reactor 40 were mixed and sent via line 50 to product treatment and separation processes.

Clearly, depending on the decoking period for the selected feed, a reactor comprising ten pyrolysis rows and two decoking rows which may be neighbouring or separated could be used, connected to a steam cracking furnace comprising twelve tubes in total, two of which being simultaneously decoked.

Comparative Example

The hydrocarbon feed for pyrolysis was an effluent from an industrial ethane steam cracker which had operated at a temperature of 900° C., the effluent being cooled to 450° C. by a transfer line exchanger. This feed, introduced via line 10, was distributed between five lines (nos. 11,13, 14, 15 and 16) corresponding in the example above to five rows operating in pyrolysis mode (nos. 1, 3, 4, 5 and 6).

In each row in the pyrolysis zone, 258 kg/h of hydrocarbons and hydrogen and 86 kg/h of water from a conventional steam cracker were introduced and 378 kg/h of water was introduced via each line 17, 18, 19, 20 and 22.

With hydrocarbon valve V2 closed, 979 kg/h of steam was sent to row no. 2 in the pyrolysis zone operating in decoking mode, via valve V11 and line 21.

In this reactor, of course, reactor 30 did not exist and lines 11 to 16 were directly connected to rows 1 to 6.

The same cycles were employed as those described above. 510 kg/h of ethylene and 440 kg/h of acetylene were produced.

What is claimed is:

1. A pyrolysis and decoking unit for simultaneous pyrolysis of a hydrocarbon feed and decoking of the unit comprising:

a pyrolysis reactor (40) which is elongate in one direction (one axis) comprising at least two rows (1,2) which are substantially parallel to the axis separated by a wall (70) of refractory material located between two successive rows, each row comprising a plurality of heating means (8) disposed in at least one layer of heating elements surrounded by sleeves (7) of ceramic material which are substantially parallel to each other and substantially perpendicular to the reactor axis, at least one of the rows (1) being adapted to receive hydrocarbons and steam, at least one other (2) of said rows being adapted to receive steam, said pyrolysis reactor comprising means for hear control and modulation connected to the heating means, the pyrolysis reactor further comprising cooling means (47) for effluents produced in each row, and a steam cracking reactor (30) comprising at least two steam cracking tubes (31, 32), each of said tubes (31, 32) being connected at an extremity to a supply line for a feed (11, 12) comprising a regulating valve (V1, V2) and a supply line (22, 21) for steam comprising a regulating valve (V12, V11), the other extremity of tube (31) being connected without transfer line exchange to the row (1) receiving hydrocarbons and steam and the other extremity of tube (32) being connected without transfer line exchange the row (2) receiving steam, the steam cracking reactor further comprising means for alternately activating said valves such that one tube (31) is in the steam cracking phase and the other tube (32) is in the decoking phase, and hear regulation means such that the temperature of the steam cracking reactor is lower than that of the pyrolysis reactor.

2. A pyrolysis and decoking unit according to claim 1, wherein the pyrolysis reactor further comprises a heating zone and a cooling zone following the heating zone.

3. A pyrolysis and decoking unit according to claim 2, wherein the pyrolysis reactor further comprises means for mixing the effluents from each row before introduction into the cooling zone.

4. A pyrolysis and decoking unit according to claim 3, wherein the cooling zone comprises means for separately cooling in their respective rows the effluents produced from each row.

5. A pyrolysis and decoking unit according to claim 4, further comprising means for mixing the mixing the effluents produced from each row after the cooling zone.

6. A pyrolysis and decoking unit according to claim 1, wherein the valves are adjustable to allow for a steam to feed ratio of more than 0.5 for a feed consisting essentially of ethane, a steam to feed ratio of more than 0.7 for a feed consisting essentially of naphtha, or a steam to feed ratio of more than 1.0 for a feed consisting essentially of gas oil.

7. A pyrolysis and decoking unit according to claim 1, wherein the valves are adjustable to allow for an introductory steam flow rate in the tube in the decoking phase which is 1.1 to 4 times higher than the introductory steam flow rate in the tube in the steam cracking phase.

* * * * *

UNITED STATES PATENT AND TRADEMARK OFFICE

CERTIFICATE OF CORRECTION

PATENT NO. : 6,322,760 B1
DATED : November 27, 2001
INVENTOR(S) : Busson et al.

It is certified that error appears in the above-identified patent and that said Letters Patent is hereby corrected as shown below:

Column 9,
Line 22, after "exchange" insert -- to --.

Signed and Sealed this

Twelfth Day of August, 2003

JAMES E. ROGAN
*Director of the United States Patent and Trademark Office*